US005600728A

United States Patent [19]

Satre

[11] Patent Number: 5,600,728

[45] Date of Patent: Feb. 4, 1997

[54] MINIATURIZED HEARING AID CIRCUIT

[76] Inventor: Scot R. Satre, 5235 LaCorte Bonita, Concord, Calif. 94521

[21] Appl. No.: 353,813

[22] Filed: Dec. 12, 1994

[51] Int. Cl.[6] ..... H04R 25/00

[52] U.S. Cl. ..... 381/68.2; 381/68; 381/123

[58] Field of Search ..... 328/167; 381/98, 381/68, 68.2, 68.4, 68.6, 69, 69.2, 123; 179/15.55 R; 333/173

[56] References Cited

U.S. PATENT DOCUMENTS

| | | | |
|---|---|---|---|
| 4,001,664 | 1/1977 | Hyltin | 323/282 |
| 4,401,855 | 8/1983 | Broderson et al. | 179/15.55 R |
| 4,622,511 | 11/1986 | Moore | 323/282 |
| 4,644,304 | 2/1987 | Temes | 333/173 |
| 4,882,761 | 11/1989 | Waldhauer | 381/106 |
| 4,882,762 | 11/1989 | Waldhauer | 381/106 |
| 5,182,521 | 1/1993 | Chang | 328/167 |
| 5,278,912 | 1/1994 | Waldhauer | 381/68.4 |
| 5,402,494 | 3/1995 | Flippe et al. | 381/68.2 |

*Primary Examiner*—Curtis Kuntz
*Assistant Examiner*—Vivian Chang
*Attorney, Agent, or Firm*—Robert Samuel Smith

[57] ABSTRACT

A microelectronic circuit featuring techniques for further miniaturization having particular interest for devices such as hearing aids characterized as having four sections: one section containing "normal use" circuits, a second section having "special use" circuits, a third section for "control"; and a fourth section containing passive components which are generally physically large. The "normal use" section contains those circuits that are in use most of the time. For hearing aids this would include, e.g., programmable audio response circuits. The "special use" circuits are those circuits that are in use for only a short period of time. For hearing aids, this would include a memory for storing the user's hearing loss prescription. The control circuit includes circuits for switching the large passive elements of the fourth section back and forth between the "normal use" sections and the "special use" sections.

1 Claim, 6 Drawing Sheets

MINIATURIZED HEARING AID CIRCUIT

FIELD OF THE INVENTION

This invention relates to further miniaturization of microelectronic circuits and particularly to miniaturization of circuits such as are used in hearing aids.

PRIOR ART AND INFORMATION DISCLOSURE

The circuits used in hearing aids are important examples of situations where an electronic device must be designed to fit in a very confined space. For hearing aids, the confined space is the aural canal (ITE),in-the-canal (ITC) or behind-the-ear (BTE). The circuits for a hearing aid is designed to permit an examining aural specialist to adjust audio response to accommodate individual needs of the user. Some common parameters are Gain, Frequency Response and Compression.

For example, the user may have hearing ability that is normal except for faint sounds. In this case, the circuit parameters must be adjusted to amplify hint sound but transmit more intense sound with no gain. For this situation, the user needs the compression parameter adjusted.

Another example is where the frequency response of the ear of the user is worst for certain frequencies. Therefore, the circuit parameters are adjusted to provide a gain vs. frequency response curve that accommodates the needs of the user.

Some of the more sophisticated hearing aids in today's an provide a means by which the circuit parameters can be digitally programmed. The digital nature of these state of the art hearing aids has eliminated the use of small potentiometers such as are used in the less sophisticated aids and are used to manually adjust circuit parameters. Memories introduced into these aids give the hearing aid a means for permanently storing the users program in digital form.

In the hearing aid art there are also methods by which the user is able to change circuit parameters at any time by using a remote control. This allows the user to change the audio characteristics of the hearing aid between several operational situations. For example, the user may want to change parameters in situations where the user is in a quiet environment which requires discrimination of slight sounds.

U.S. Pat. No. 4,882,761 to Waldhauer discloses a programmable low voltage compressor circuit wherein gain and compression ratio may be programmed over a wide range and may be powered from a power source as low as 1.1 volt.

U.S. Pat. No. 4,882,762 to Waldhauer discloses a circuit for a hearing aid in which the audio signal is received by a band split filter which separates the signal into a plurality of frequency bands. Each of the respective frequency bands is compressed by a compressor in accordance with the needs of the user. This is accomplished by setting the compression ratio of each compressor in response to one of a set of control signals. The outputs of the compressor are then summed to generate a composite audio signal.

U.S. Pat. No. 5,278,912 to Waldhauer discloses a programmable low voltage compressor circuit which features a variable gain amplifier with a linear transfer function controllable by an electric signal and which is adaptable to a low supply voltage.

U.S. Pat. No. 4,396,806 to Anderson discloses a hearing aid that incorporates digitally programmable circuitry. It also discloses a means for permanently storing the users program by using a programmable read only memory (PROM)

U.S. Pat. No. 4,975,653 to Becker discloses a transmitter/receiver circuit that can be used for a remote controlled hearing aid system. The system allows the user to digitally change the audio characteristic by use of a remote control while the user is wearing the hearing aid.

The present state of the art disclosed by Waldhauer describes the use of many circuits that are combined together to provide the audio characteristics of a hearing aid. Becker discloses a means by which a hearing aid can be digitally programmed via remote control. These are good examples of the types of circuits that are in use for the majority of time during the life of the hearing aid. These are the circuits that can be labelled as the "Normal-Use" circuits.

On the other hand, there is hearing aid art where circuits arc used for only a small fraction of the operating life of the hearing aid. These circuits are used to perform "special-functions". An example of this is the programming interface described in Anderson's patent. He describes interface circuitry that is used only once in the life of the hearing aid to program the volatile memory.

The "normal-use" circuits in the present art of the hearing aid require many different types of circuits such as preamps, compressors, peak detectors and band split filters. These are circuits which are designed into one or more integrated circuits along with external passive components that can not be incorporated onto an integrated circuit. Unfortunately, a major part of the space required for the normal-use circuits is the inclusion of external passive components such as capacitors and inductors.

Likewise, the "special function" circuitry is designed into one or more of the integrated circuits and may also require external passive components that cannot be incorporated into the integrated circuits.

This requirement of having "normal use" and "special functions" circuits each requiring its own set of external components increases the physical size of the device. Any reduction of physical size is an improvement in the art since the typical user is very desirous to having the hearing aid be as inconspicuous as possible.

Other patents which are also germane to the background of the invention are:

U.S. Pat. No. 4,001,664 to Hyltin discloses a DC Potential multiplier circuit using a switched capacitor in which the circuit is a single function circuit that is always active.

U.S. Pat. No. 4,622,511 to Moore discloses a switching regulator that uses a switched inductor in a circuit that is always active.

U.S. Pat. No. 5,182,521 to Chang and Tong discloses a multifilter circuit in which the capacitors are switched at a high rate such that each filter circuit remains continually active.

SUMMARY OF THE INVENTION:

It is an object of this invention to provide a microelectronic circuit having a reduced physical size compared to microelectronic circuits.

It is an object of this invention to provide a hearing aid circuit that is more compact than circuits of comparable performance and therefore more attractive to a user public where inconspicuousness is a desirable characteristic.

In the general application of the invention, a circuit is separated into active sections and a passive section. Each active section is active during a period when all of the other active sections are inactive. In the context of this specification, the term, "external passive component" is understood to mean a component such as a capacitor, inductance or precision resistor that is too large to be included on a chip or with other circuit components. External passive components, such as capacitors, inductances and precision resistors which are normally a part of each section according to the present art, form separate passive section and is connectable to the active sections by switches that are closed to one of the active sections during a time period. Thus, by time sharing the passive components among sections, the number (and often size) of passive components is reduced thereby substantially reducing the size of the circuit.

In application of the invention to construction of hearing aids, the circuit includes four sections:

One section includes "normal use"circuits" which are the circuits that are active when the user is wearing his hearing aid to correct hearing loss. The normal use circuit includes components such as a preamplifier, bandpass filters, a compressor for each frequency band, a summing circuits and remote control receiver circuits. The "normal-use" circuits are in use for a majority of the operating life of the hearing aid.

A second section includes "special function" circuitry which may contain such functions as programming default parameters for the normal use circuit. This section contains the programmable memory, and control circuitry that the physician "sets" in order to develop the desired gain characteristics for his patient. The "special function" section will include such circuits as nonvolatile memory, voltage doublers, or a DC-DC converter (switcher) to provide a larger voltage for the special functions than is required for the normal use circuits. These circuits are used for only a small fraction of the total operating life of the hearing aid.

A third section contains the control circuitry which determines when the "normal use" section is active and the "special use" section is inactive and visa versa.

A fourth section contains the physically large passive components, including capacitors, inductors and precision resistors, which are switched by the control circuitry from one section to another according to the scheduled use of the sections. Accordingly, in the context of this specification, the term "control circuit (CC) switches" is understood to mean the switches that switch the external passive elements between the normal use and special use circuits. The control circuit operates by detecting when a condition has been achieved in the special use circuit which causes the control circuit to operate the control circuit switch to switch the external passive components from the special use circuit to the normal use circuit thereby ending the special use period and initiating the normal use period.

Figure 1:
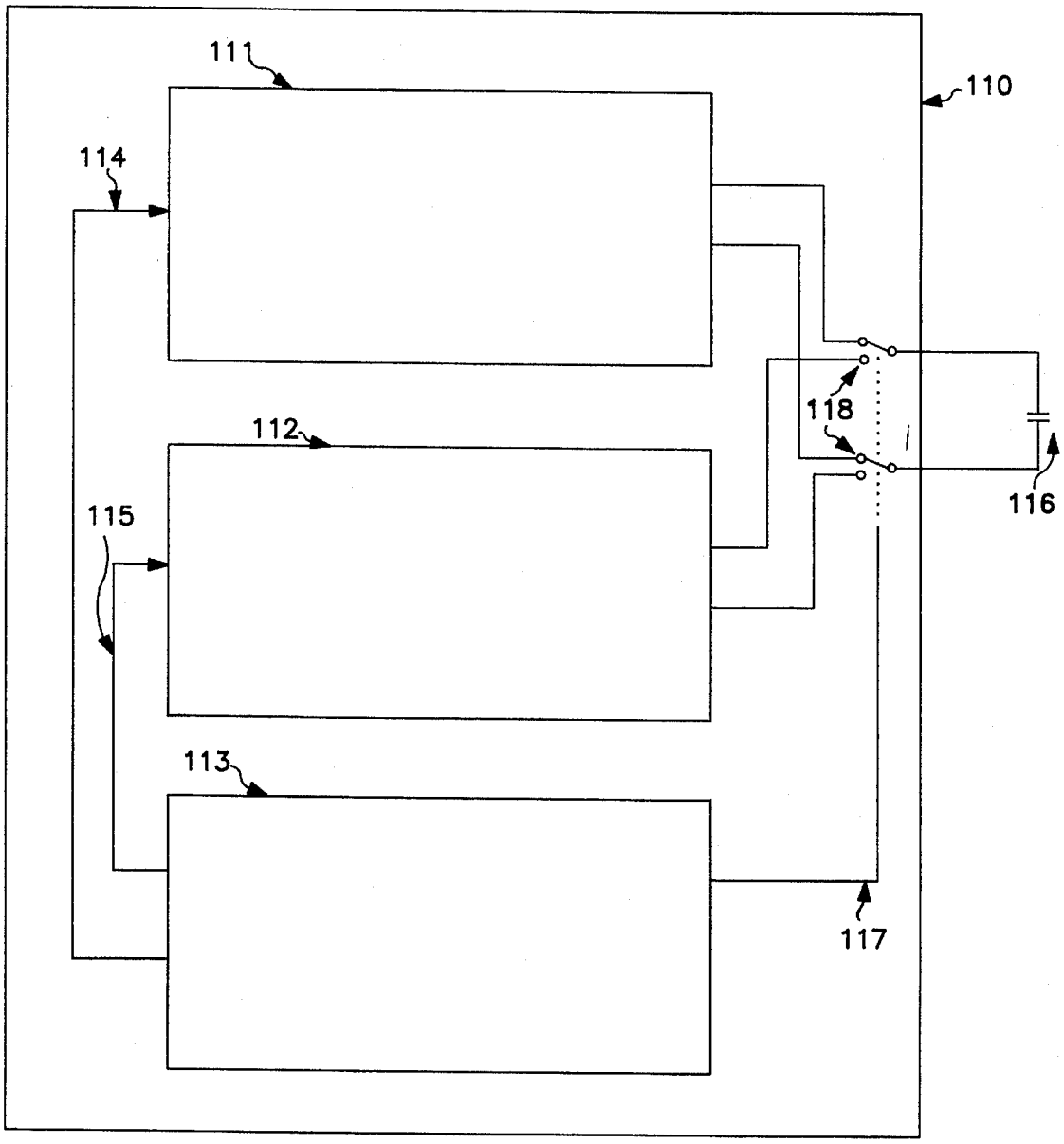
FIG. 1 illustrates the invention for general application.

DESCRIPTION OF THE BEST MODE:

Turning now to a discussion of the drawings, FIG. 1 shows the architecture in its simplest form. Circuitry that can be contained in one or more integrated circuits is shown by 110. Circuitry block 110 represents all circuitry that can be fabricated within the integrated circuits. The circuitry within 110 is divided into three sections.

Section 111 represents all circuitry that is active during time intervals $T_{a,b,}$--. Section 112 represents circuitry that is used during time intervals $T_{u,v,}$--. Section 111 and section 112 are different functions and are never active at the same time. Section 113 represents circuitry that contains the intelligence to control when circuit 111 is in use and when circuit 112 is in use. Circuitry 111 is enabled by control line 114 and circuitry 112 is enabled by control line 115. Control circuitry 113 contains the intelligence to control the circuit controlled switch 118 and time-shares external (passive) component 116 between circuitry 111 and 112 by using signal 117. Thus, in the simple example shown, one external passive component is eliminated which is a significant reduction for some important applications.

Figure 2:
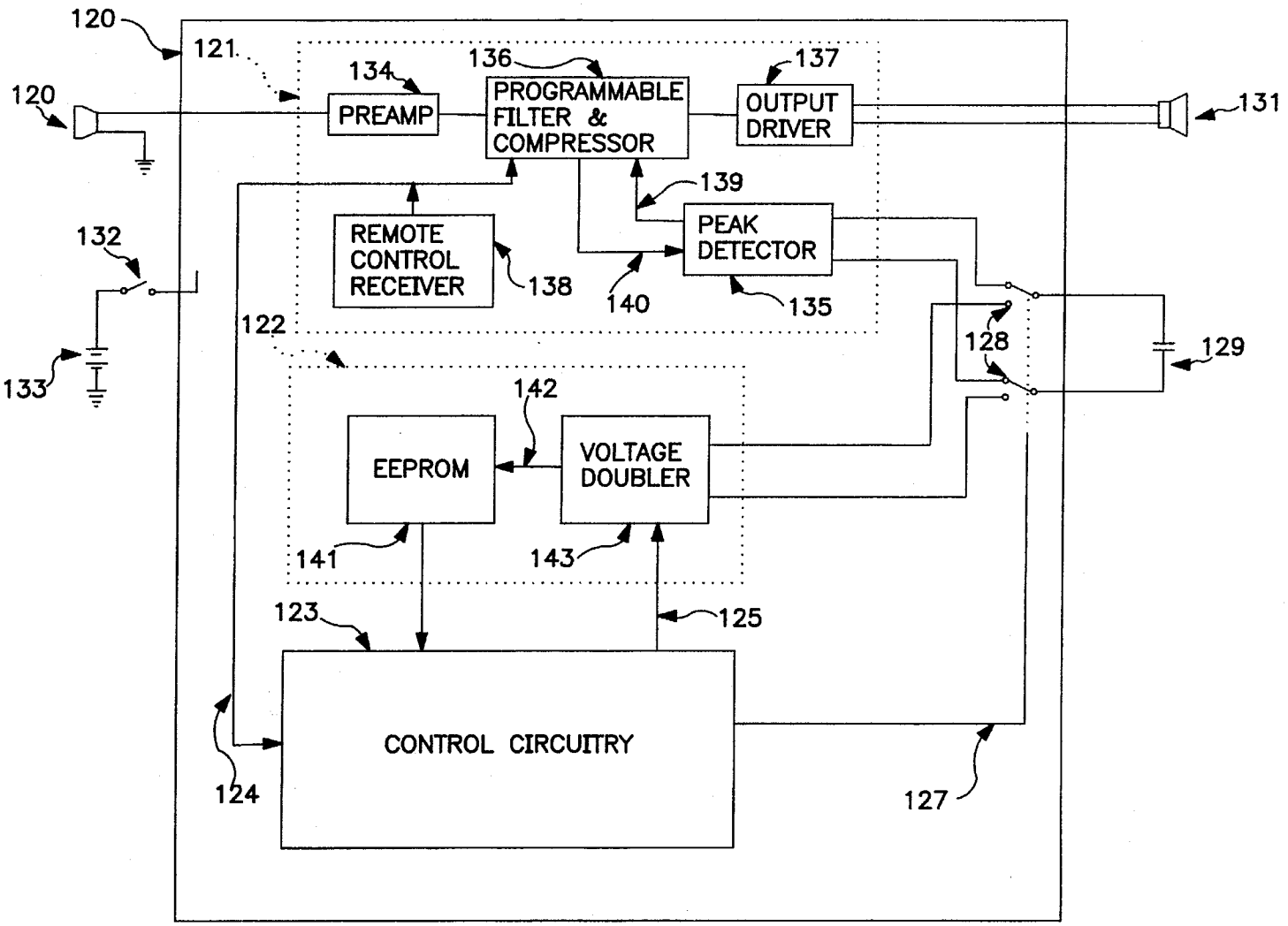
FIG. 2 is a block diagram showing separation of a hearing aid into a "normal use" section and a "memory access" section.

FIG. 2 shows a block diagram of a programmable hearing aid system design that incorporates the invention. Circuitry in block 120 represents all circuitry that can be fabricated within one or more integrated circuits and is segregated into three sections as follows:

Circuitry in section 121 contains "normal use" circuitry, the circuitry that is active when the user is wearing and listening with his hearing aid. "Normal use circuitry" includes audio circuits that process the audio signal originating from the microphone 130 and is delivered to a speaker, 131. "Normal use" circuitry may contain circuits such as a preamp 134, peak detector 135, programmable filter and compressor 136 and speaker driver 137. Remote control receiver circuits 138 may also be included in the "normal use" circuits. One or more of the circuits within "normal use " circuitry may require an external passive component. FIG. 2 illustrates this requirement showing the capacitor 129 connectable to the peak detector 135 through switch 128.

Section 122 contains the "special function" circuitry. More specifically, this is the memory-access circuitry which is where the patients program is stored. The program customizes the audio response according to the patients hearing loss. An EEPROM memory 141 is used in order to retain the program in memory when the power is turned off by opening switch 132 connected to battery 133. The problem with state of the art EEPROM is that it requires a greater operating voltage than do the sections of the "normal use" circuits. Therefore, a voltage doubler 143 must be used to operate the EEPROM 141. The voltage doubler 143 requires a capacitor which is provided in the example of FIG. 2 by connecting one set of poles of switch 128 to the voltage doubler and the other set of poles of switch 128 to the peak detector.

Control circuitry 123 controls how the single external component 129 is time shared between the peak detector 135 in the normal use circuitry 121 and the voltage doubler 143 in the memory-read circuitry 122.

Figure 3:
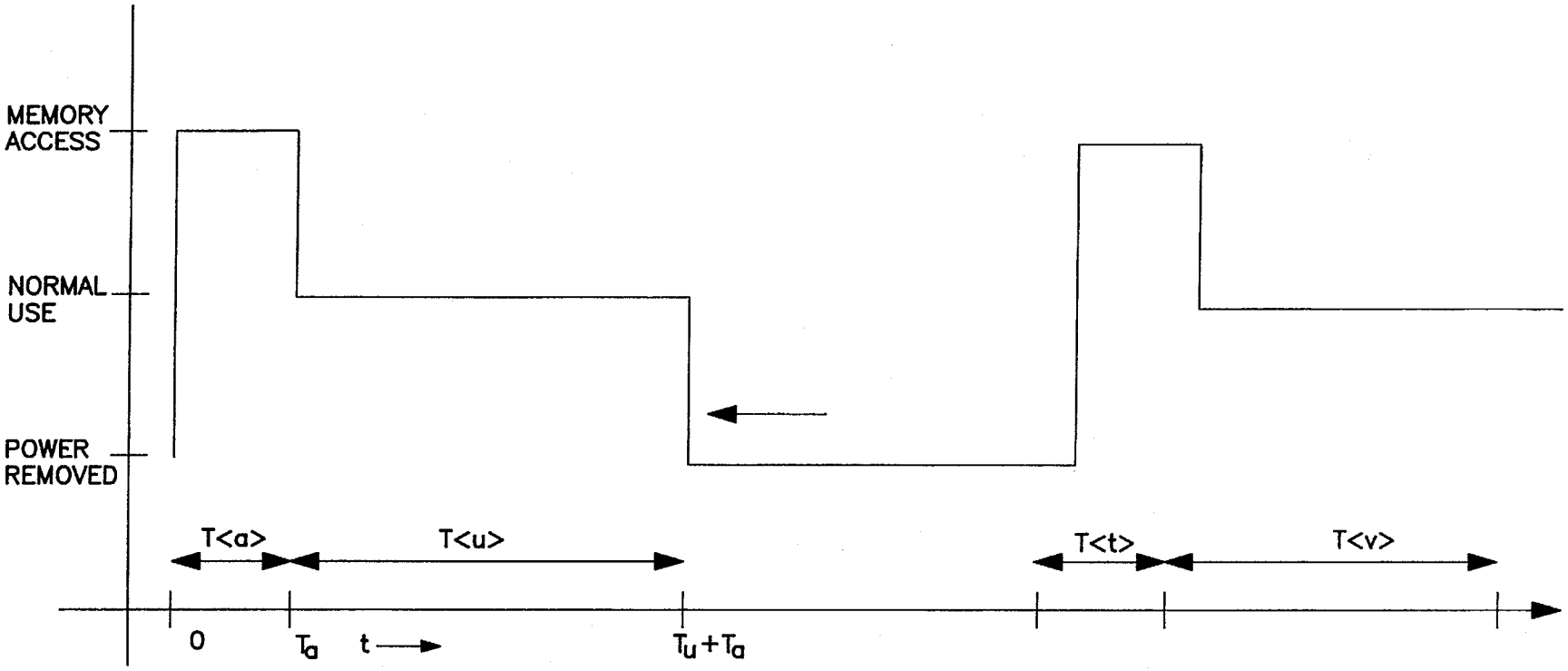
FIG. 3 is a timing diagram for FIG. 2.

FIG. 3 is a timing diagram illustrating operation of the circuit of FIG. 2.

No power is applied during the time before t=0 because switch 132 is open. Power is applied by closing switch 132 at time t=0. The control circuitry begins a "power-on sequence at time t=0 and activates the memory access circuits 122. A control signal on line 127 activates switch 128 to connect external component 129 to voltage doubler 143 and control signal 125 turns on the voltage doubler 143. Voltage doubler 143 delivers the increased voltage to EEPROM 141 by way of signal line 142. The control circuitry 123 reads the program out of EEPROM 141 by way of signal line 126. This brings us to the end of the time interval $T_a$ shown in FIG. 3 and it is time to activate the "normal use" circuits in 121. The control circuitry 123 transfers the program to the "normal use" circuits 121 on line 124. The control signal 127 then changes switch 128 so that the external component 129 is now connected to the peak detector 135 in the normal use circuit 121. The capacitor now is connected so that the peak detector performs its normal function of storing peak values of the input signal 140. This brings us to the beginning of time interval $T_u$ in FIG. 3. The time interval $T_u$ can represent the end of the day where the hearing aids are removed from the user and the power is removed by opening switch 132.

In the above example, the time required by the memory-access circuitry to use the external power is very short, generally a fraction of a second. The time of operation of the normal use circuitry is generally several hours per day.

The foregoing paragraph illustrates the invention using only one voltage doubler and two external capacitors. In fact, EEPROMS may require many doublers and numerous capacitors.

Figure 4:
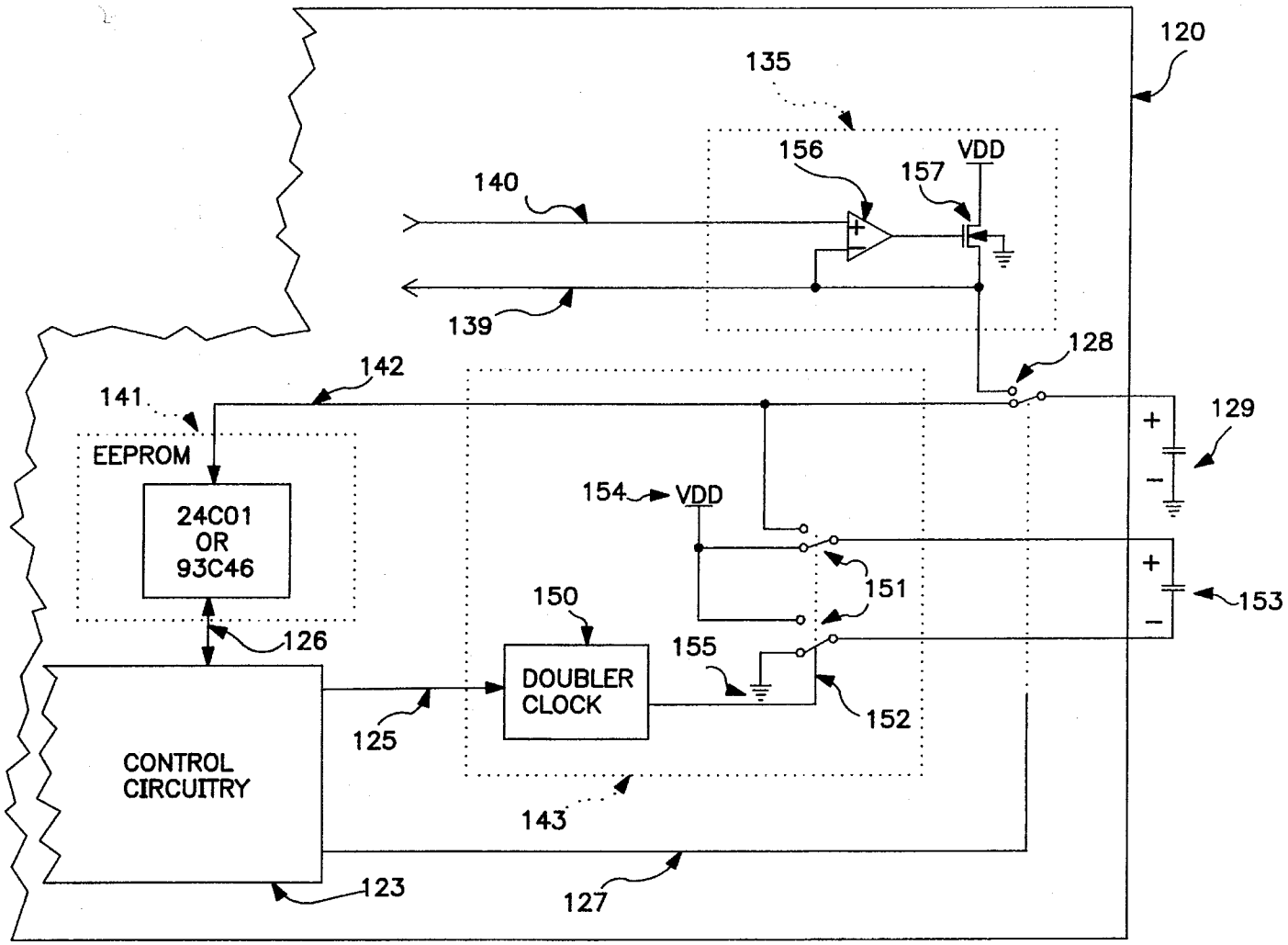
FIG. 4 is a section of FIG. 2 showing a detailed diagram of the invention.

FIG. 4 shows a detailed section of 120 that contains the peak detector 135 and the voltage doubler 140 and which incorporate the invention. The circuitry 120 contains circuits that can be fabricated within one or more integrated circuits. The voltage doubler 143 in FIG. 4 is shown as requiring two external components. External capacitor 129 is time shared between the peak detector 135 and the voltage doubler 143.

The switch 128 shown in FIG. 4 is simpler than the switch 128 shown in FIG. 3. This is because the peak detector 135 and the voltage doubler 143 each require an external capacitor 129 that has its negative lead to ground. Therefore the detailed example of FIG. 4 requires just a single switch 128.

The EEPROM memory block in FIG. 4 is shown by 141. The EEPROM configuration chosen for this example is an EEPROM which is an off-the-shelf standard integrated circuit. There are two family types that can be used. The 93C46 EEPROM which uses a tree-wire interface (to the internal controller 123) or the 24C01 EEPROM which uses a two wire interface to the internal controller 123. Therefore the signal line 126 will represent either a 2-wire or a 3-wire interface.

In FIG. 2, EEPROM 141 is programmed via controller circuit 123 and signal 126 by means of interface signal 126.

The 93C46 and 24C01 family of EEPROMs are manufactured by a number of companies including ATMEL CATALYST, MICROCHIP. Their use and operation is fully disclosed, for example, in "CMOS Data Book" 1993–1994, available from the Atmel Corp. 2125 O'Nel Drive, San Jose, Calif. 95131 which is hereby incorporated as reference into this specification.

These off-the-shelf EEPROMs contain within them numerous voltage doublers which generate an internal voltage of greater than 20 volts. The voltage is necessary to perform the tunneling phenomenon which is characteristic of all EEPROMs. The availability of these standard parts eliminates the necessity of designing numerous voltage doublers. However, these standard parts require a minimum voltage of 2.0 volts to operate. Thus them is a requirement to double the battery voltage 133 (VDD=1.1 volts) up to 2.0 volts. When control circuitry 123 has determined that it is to enable the memory access circuitry, it uses signal lines 125, 127, and 126. Signal line 126 connects the external capacitor 129 to the voltage doubler 143 by means of switch 128. Signal line 125 starts the doubler clock 150. The doubler clock circuit 150 controls a pair of switches 151 at a high frequency rate (10 kHz–100 kHZ) by means of signal line 152. During one half of the doubler clock, the capacitor 153 is connected across VDD 154 ground 155. The capacitor 153 receives a voltage charge VDD. During the other half of the doubler clock, switch 151 is thrown into the other position by means of signal 152. Now the negative lead of capacitor 153 is connected to VDD 154 and the positive lead is connected to capacitor 129 by means of switch 128. Thus capacitor 128 has a total potential of $2_+$ volts across its terminals. This process of using capacitor 153 to place 2 volts on to capacitor 129 is done many times while in the memory access mode. This allows signal line 142 to maintain a 2 volt potential while EEPROM 141 draws a small amount of current.

When the "normal use" circuitry is active, control circuitry 123 connects external capacitor 129 to the peak detector 135 by means of switch 128 and signal line 127. When the input 140 to the peak detector 135 is greater than its output 139, comparator 156 turns on the MOSFET 157. MOSFET 157 raises the potential of external capacitor 129 until the output 139 equals the input 140. If the input 140 now falls below, 139, the comparator 156 will shut off MOSFET 157 and external capacitor 129 will maintain its maximum potential because there is no mechanism to discharge 129.

FIG. 4 thereby demonstrates the principle of the invention by time sharing capacitor 129 between the memory access circuits and the normal use circuits. In the example shown, the physical size of the circuit is reduced by eliminating one capacitor. In the example, it is possible to also time share the external capacitor 153 to further reduce the size of the circuit.

Figure 5:
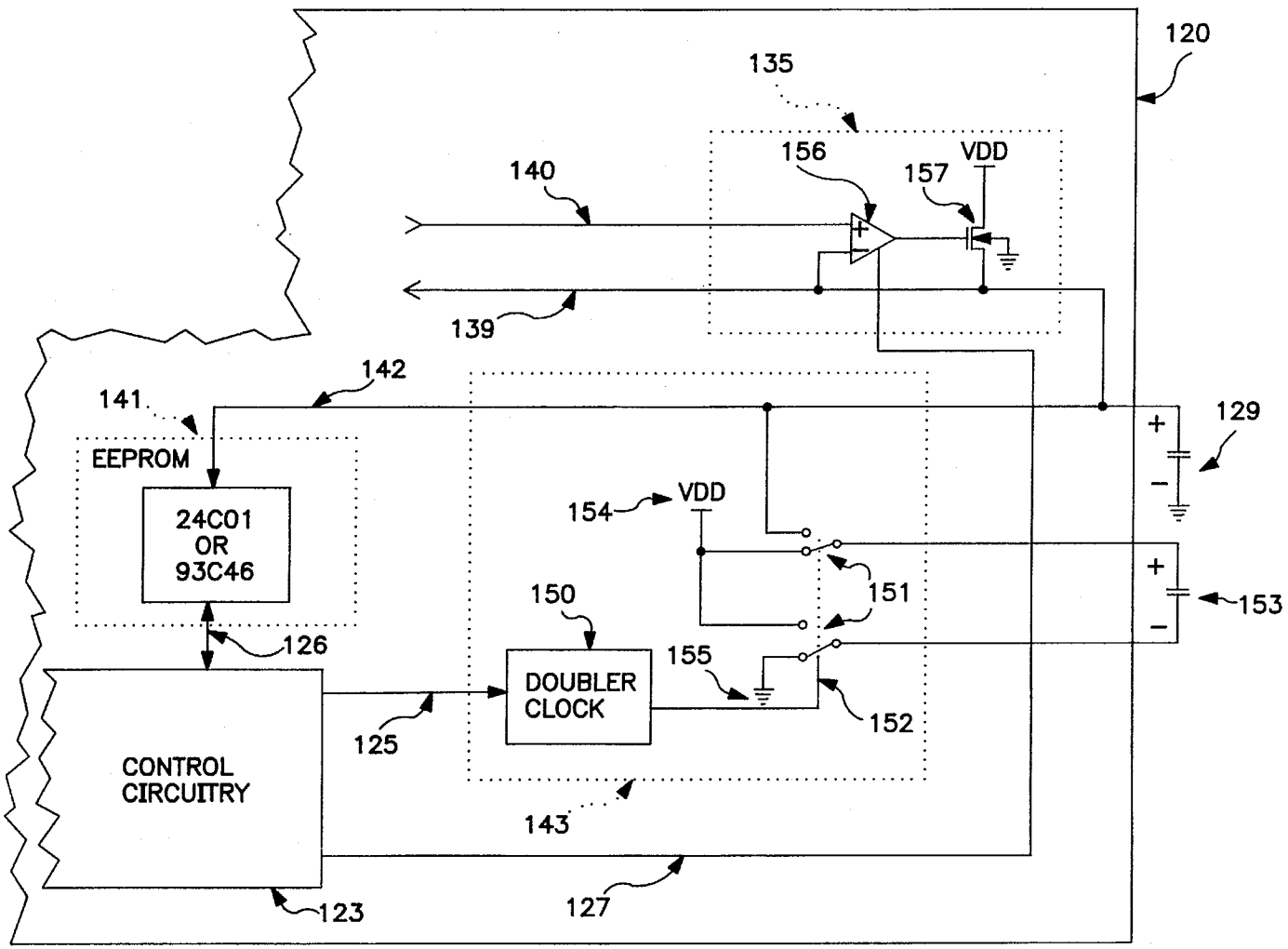
FIG. 5 is a version of FIG. 4 where the time-share switch is implicit.

FIG. 5 shows a version of the circuit in FIG. 4 where the time share switch 128 is not explicitly shown as in FIG. 4. In this example, control circuitry 123 enables or disables the peak detector 135 by means of signal line 127. When the voltage doubler 143 and EEPROM 141 are active, the peak detector 135 is inactive, so that the voltage on external capacitor 129 is not disturbed. Likewise, when the peak detector 135 is active, the EEPROM 141 and voltage doubler are inactive so that the peak voltage on external capacitor 129 is not disturbed. The proper way to disable the voltage doubler 143 is to leave the switch 151 in the down position so that the external capacitor 153 is not connected to the output line 139 of the peak detector. This is done by means of signal line 152 . The EEPROM can be disabled easily through the interface line 126. When EEPROM 141 is disabled, its standby current draw is only a few microamps and therefore will not disturb the peak voltage on external capacitor 129.

Figure 6:
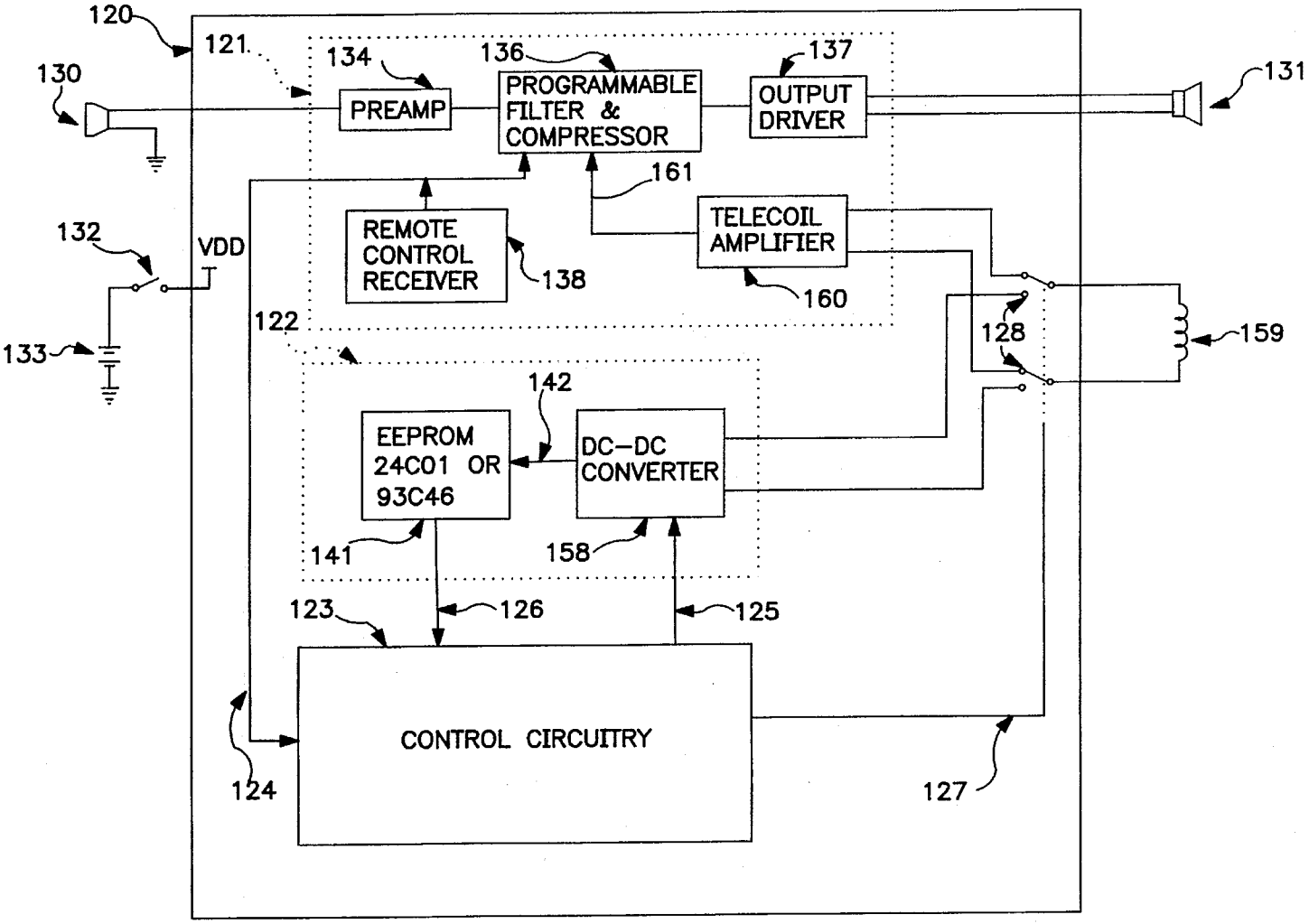
FIG. 6 illustrates the invention for the hearing aid in FIG. 2 using a DC-DC converter instead of a voltage doubler.

FIG. 6 illustrates the invention for a hearing aid circuit in which a DC-DC converter 158 is used instead of the voltage doubler 143 of FIG. 2. The DC-DC converter is used because he external passive element is now an inductor 159. This inductor 159 is time shared between the normal use circuits 121 and the memory access circuit 122.

When the circuits of 121 arc active, the inductor functions with the telecoil amplifier circuit 160 as shown in FIG. 6.

The telecoil function allows the user to easily use the telephone. The telecoil (inductor) works by picking up the electromagnetic field produced by the telephone receiver. The telecoil signal is introduced to the audio path by injecting the amplified signal 161 into the filter and compressor circuits 136.

When the inductor 159 of FIG. 6 is used while the memory-access circuit 122 is active, it functions as part of a DC-DC converter circuit. DC-DC converter circuits use the fly-back property of inductors to generate output voltages much higher than the input voltage.

Operation of DC-DC converters is fully disclosed in "DC-DC Switching Regulator Analysis" by D. Mitchell, published by McGraw Hill, 1988, ISBN 0-07-042597-3 which is hereby incorporated by reference into this specification.

The DC-DC converter 158 and inductor 159 can easily generate a voltage of 5 volts on signal line 142. The off-the shelf EEPROM type used for 141 can now be a 5 volt version. The advantage of using a 5 volt version of a off-shelf EEPROM such as the 93C46 or 24C01 is that they are less expensive than their 2 volt counterpart.

Another variation of the circuit in FIG. 6 is where the inductor is actually the coil element of the speaker.

Other variations incorporating the principles of the invention may be applied which are within the scope of the invention. I therefore wish to define the scope of my invention by the appended claims.

I claim:

1. An electronic circuit for performing a first set of functions during a first period and a second set of functions during a second period wherein the first period is initiated at unscheduled times and the second period is initiated when said first set of functions is complete thus ending said first period, said circuit comprising:

a group of external passive components including at least one of (i) at least one capacitor;

(ii) at least one inductor;

a normal use circuitry means having a first group of integrated circuit parts connected together and adapted for actively performing said first set of functions when said normal use circuitry means is connected to said group of external passive components and for being inactive when said normal use circuitry means is disconnected from said group of external passive components;

said normal use circuitry means including a microphone, an output transducer such as a speaker, and circuit means for shaping audio response;

a special use circuitry means having a second group of integrated circuit parts connected together and adapted for actively performing said second set of functions when said special use circuitry means is connected to said group of external passive components, said special use circuitry means including EEPROM means for programming audio response of said normal use circuitry means;

means for accessing said EEPROM means connected to said EEPROM means; circuit means having terminals connected to said EEPROM means and adapted for increasing a supply voltage applied to said EEPROM means when connected to a supply voltage source and said group of external passive external components;

switch means connecting said group of external components to said circuit means for increasing said supply voltage when it is required to operate said electronic circuit for memory access and connecting said group of components to said normal use circuit means for shaping audio response when it is required to operate said electronic circuit for normal use.

* * * * *